US005630368A

United States Patent [19]

Wagoner et al.

[11] Patent Number: 5,630,368

[45] Date of Patent: May 20, 1997

[54] COAL FEED AND INJECTION SYSTEM FOR A COAL-FIRED FIRETUBE BOILER

[75] Inventors: Charles L. Wagoner; John P. Foote, both of Tullahoma, Tenn.

[73] Assignee: The University of Tennessee Research Corporation, Knoxville, Tenn.

[21] Appl. No.: 395,384

[22] Filed: Feb. 21, 1995

Related U.S. Application Data

[63] Continuation-in-part of Ser. No. 66,783, May 24, 1993, Pat. No. 5,429,059.

[51] Int. Cl.[6] ..... F23B 7/00

[52] U.S. Cl. ..... 110/234; 110/105; 110/261

[58] Field of Search ..... 110/104 B, 105, 110/109, 261, 263, 293, 245; 431/162, 173, 183; 414/208, 147, 299

[56] References Cited

U.S. PATENT DOCUMENTS

| | | | |
|---|---|---|---|
| 706,495 | 8/1902 | Reed | 110/105 X |
| 2,380,169 | 8/1945 | Gygi | 110/261 X |
| 2,399,234 | 4/1946 | Kreisinger et al. | 110/104 B |
| 4,274,587 | 6/1981 | Cioffi et al. | 110/104 B X |
| 4,381,718 | 5/1983 | Carver et al. | 110/347 |
| 4,501,204 | 2/1985 | McCartney et al. | 110/264 |
| 4,603,680 | 8/1986 | Dempsey et al. | 126/99 R X |
| 4,630,554 | 12/1986 | Sayler et al. | 110/104 B X |
| 4,693,189 | 9/1987 | Powers | 110/105 X |
| 4,796,547 | 1/1989 | Kobayashi et al. | 110/263 |
| 4,892,045 | 1/1990 | Schumacher | 110/203 |
| 4,899,726 | 2/1990 | Waterman | 126/99 R X |
| 4,989,549 | 2/1991 | Korenberg | 122/149 |
| 5,161,488 | 11/1992 | Natter | 122/1 R |
| 5,341,795 | 8/1994 | Chou et al. | 126/110 R X |

*Primary Examiner*—Henry A. Bennett
*Assistant Examiner*—Susanne C. Tinker
*Attorney, Agent, or Firm*—Rosenblatt & Redano, P.C.

[57] ABSTRACT

This invention relates to an improved coal injection and coal feed system for use with a coal-fired firetube boiler. More specifically, the coal injection system of the present invention comprises an educator and a coal delivery tube. The coal feed system of the present invention comprises a coal hopper, gyratable bin, gyration device, discharge plenum and feed conveyor.

11 Claims, 9 Drawing Sheets

COAL FEED AND INJECTION SYSTEM FOR A COAL-FIRED FIRETUBE BOILER

RELATED APPLICATIONS

This application is a continuation-in-part of application Ser. No. 08/066,783, filed on May 24, 1993, U.S. Pat. No. 5,429,059, issued Jul. 4, 1995.

BACKGROUND OF THE INVENTION

1. Field of the Invention

This invention relates to an improved coal injection and coal feed system for use with a coal-fired firetube boiler.

2. Description of the Prior Art

Currently there is a very large number of gas-fired boilers which are operational. In a typical gas-fired boiler, the fuel combustion takes place in a firetube with the walls of the tube being heated by the combustion. Water is circulated past the outer wall of the tube and in heat transfer relationship to the walls of the firetube, so that the water is converted to steam. In a typical boiler, the heated gases from the combustion are caused to flow along several additional tubes which are contained within the boiler, with the external walls of these additional tubes being also exposed to the water so as to increase the efficiency of heat transfer from the hot combustion gases to the water and thereby increase the efficiency of the steam-formation function.

Gas-fired boilers commonly are fueled by means of natural gas, propane or other gaseous fuel, or by oil (which is mixed with air to generate a type of mist that is injected into the firetube). In Public Law 99-190, Laws of the 99th Congress-1st Session, it was mandated "to rehabilitate and convert current steam-generating plants at defense facilities in the U.S. to coal-burning facilities in order to achieve a coal consumption target of 1,600,000 short tons of coal per year above current consumption levels at Department of Defense facilities in the United States by fiscal year 1994; Provided, That anthracite or bituminous coal shall be the source of energy at such installations; Provided further, That during the implementation of this proposal, the amount of anthracite coal purchased by the Department shall remain at least at the current annual purchase level, 302,000 short tons."Successful completion of this mandate, at minimum cost, dictates that there be a conversion of the existing gas-fired boilers to coal-fired boilers.

Conversion of a firetube boiler to a coal-fired boiler is complicated by reason of the relatively short length of the firetube. Combustion of a gas or oil fuel in a boiler requires less lineal distance for the combustion reaction than for the combustion of coal as the fuel. This is due in major part to the fact that conversion of the carbon content of the coal requires a longer time period than does the conversion of the carbon content of the gas or oil fuels. Consequently, firetube boilers have a smaller combustion volume than coal-fired boilers. Further, in firetube boilers, there is a high rate of heat loss to the water-cooled walls of the tubes within the boiler, which rate of heat loss adversely affects the combustion rate of coal burned in the same firetube.

Goals for coal-fired boilers include (1) greater than 99% carbon conversion efficiency, (2) greater than 80% boiler efficiency, (3) $NO_x$ emission less than 0.7 lb/MBtu, and (4) turndown ratio of 3-to-1.

Coal delivery systems are used in conjunction with coal-fired boilers to deliver coal to the boiler. Prior art coal delivery systems have used large pressurized coal storage tanks in conjunction with an airlock system to deliver coal to the boiler. Such prior art coal delivery systems have also required the use of a control valve at the coal feed line in order to regulate the flow of coal to the boiler. Such control valves can create a restriction in the flow area which is a source of plugging when micronized material, such as finely divided coal, is injected through the feed line into the boiler.

SUMMARY OF THE INVENTION

In accordance with the present invention, there is provided a system to inject coal more efficiently into a coal-fired firetube boiler and to feed fluidized coal more efficiently from a coal hopper to a coal-fired firetube boiler.

The present invention includes replacement of the gas or oil injector unit for a firetube boiler with a novel coal injector unit, provision of a dense, constant, and controllable feed stream of finely divided coal, establishing and maintaining an initial reducing environment within the inlet region of the tubular combustion chamber of about 0.55 stoichiometry while developing an overall combustion stoichiometry of about 1.2 over the length of the combustion chamber, and dividing the combustion air admitted to the combustion chamber into multiple streams, each of which is introduced to the combustion chamber at physically separated locations along the length of the combustion chamber.

In particular, in accordance with the present invention, coal is comminuted to a micronized state, fed from a storage vessel, such as a coal hopper, via a gyratable bin to a discharge plenum wherein the finely divided coal is fluidized by an inert gas, and in turn fed via a feed conveyer device to a conduit that leads to the inlet of a specially designed coal injection system comprising an annular eductor.

Motive air for educting the dense coal stream and injecting the mixture of coal and air into the inlet end of the inlet nozzle of a firetube is provided by a blower or pump means. The inlet nozzle comprises an eductor. The quantity of coal admitted to the combustion chamber is a function of the pressure of the air employed as the educting fluid, assuming a constant pressure drop vs. coal flow rate characteristic in the feed line. This means of controlling rate or quantity of coal feed is distinct from prior art methods where feed screw rate controls the coal feed rate. The volume of motive air is chosen to represent about 15% of the air required for combustion of the coal at the selected feed rate of the coal.

One advantage of the coal delivery system of the present invention over the prior art is that the present invention does not require a control valve in the coal feed line for regulating the flow of coal. The pressure of air employed as the educting fluid results in a vacuum that sucks coal into the inlet nozzle of the firetube boiler. This vacuum feed characteristic tends to pull any lumps of packed coal apart, thereby keeping the coal flowing at a constant rate. This is an added advantage over prior art coal delivery systems wherein the use of a pressurized coal storage bin tended to compact powdered or micronized coal. Furthermore, the vacuum characteristics of the coal injection system of the present invention have been found to enhance the premixing of coal and combustion air, thereby significantly enhancing the efficiency of the combustion process.

The eductor comprises an inlet region, a reducer region comprising a large diameter and adjacent the inlet region and a small diameter end opposite the large diameter end. The eductor further comprises a mixing chamber extending longitudinally through the eductor. The mixing chamber comprises a smaller diameter and adjacent the small diameter end of the reducer region and a larger diameter end opposite the smaller diameter end. The inlet region, reducer region, and mixing chamber form a longitudinal bore through the eductor.

In the mixing chamber, a mixture of coal and motive air expands to supersonic velocity, thereby enhancing the mixing of the finely divided coal with the air to establish an efficiently combustible mixture. This mixture thereafter passes through a series of shocks within the nozzle where the air velocity decreases and the static pressure rises to match the burner operating pressure. Static pressure in the suction section of the eductor ranges as a function of the motive air pressure and the coal flow rate. For a given motive air pressure and coal flow rate, the suction pressure is constant, so for a coal feed line with repeatable pressure drop characteristics, the coal flow rate can be controlled by varying the motive air pressure.

The coal injection system further comprises a coal delivery tube having a first end attachable to a source of finely divided coal of uniform density and pressure, and a second end extending through the inlet and reducer regions, and terminating in the mixing region near the smaller diameter end of the mixing region. The coal delivery tube has an outer diameter slightly less than the smaller diameter of the mixing region. The coal delivery tube is concentrically located within the eductor so as to form an annular channel around the perimeter of the coal delivery tube in the eductor. The channel has sufficient width to permit air injected into the annular channel to draw a vacuum at the second end of the coal delivery tube.

Following the eductor, the inlet nozzle comprises a second section within which initial combustion takes place under reducing conditions, such conditions having been found to limit the formation of $NO_x$. The second section is in fluid communication with the mixing chamber. This second section includes a refractory-lined annular wall which is designed to define an annular inlet for the addition of secondary combustion air to the combustion chamber. This annular inlet preferably is provided with angular vanes which impart a clockwise swirl to the combustion air entering the initial combustion zone. This air movement stabilizes the primary flame. Approximately 30% of the required combustion air is admitted to the combustion chamber via this secondary air inlet.

The remainder of the required combustion air is admitted to the combustion chamber downstream from the initial combustion zone at a location adjacent the downstream end of the firetube. It has been found by the present inventors that this final portion of the combustion air should be introduced to the firetube via a series of jets which are disposed about the annular wall of the firetube and which are angled at about 20 degrees with respect to the diameter of the firetube such that the air enters the firetube about its inner circumference in a series of streams which create a swirl which is counter to the swirl imparted to the secondary combustion air by the vanes in the inlet nozzle. This counter swirl has been found to enhance the mixing of the final portion of the combustion air with the flame, thereby promoting efficient combustion of CO and $H_2$ in the reducing gas.

Within the primary combustion zone (between the nozzle and the location of the jets adjacent the downstream end of the firetube), it has been found to be most efficient to maintain the stoichiometry of the combustion reaction at about 0.55, but with the overall stoichiometry being established at about 1.20. Further, within this combustion zone, the firetube is provided with a refractory lining which has been found useful in isolating the reducing gases from the metal wall of the firetube, thereby minimizing both the potential for corrosion and excessive cooling of the combustion gases.

DESCRIPTION OF THE PREFERRED EMBODIMENTS

In accordance with the present invention, an industrial type firetube boiler is retrofitted for fueling by coal at a carbon conversion efficiency of at least about 99%, emissions of $NO_x$ of less than about 0.7 lb/million Btu, and a turndown ratio of at least about 3:1. The term "$NO_x$", as used herein refers to the sum total of all oxides of nitrogen formed during the combustion of the coal fuel in the retrofitted boiler, such oxides being measured at the flue gas exhaust of the boiler. "Turndown ratio" refers to the ability of the boiler to be operated continuously and its output in Btu's being regulatable between a maximum output at the maximum fuel burn rate, to a lower value which is at least two-thirds less than the maximum output. Turndown ratio is measured by the fuel burn rate.

Figure 1:
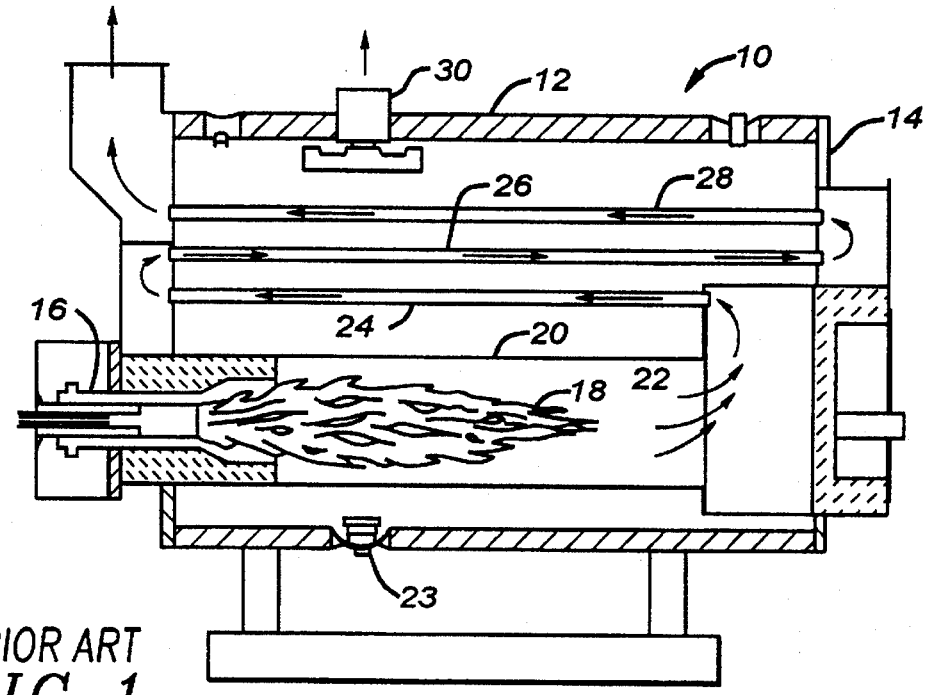
PRIOR ART FIG. 1
FIG. 1 is a schematic representation, part in section, of a typical firetube boiler of the prior art.

As depicted in FIG. 1, a typical firetube boiler 10 of the prior art comprises a cylindrical housing 12 having one of its ends closed as by a cap 14 and having its opposite end fitted with a forced draft burner 16. Propane, natural gas, oil or other combustible gas or liquid is introduced to the burner along with combustion air to develop a flame 18 within the firetube 20. Heat from the flame is transferred through the wall 22 of the firetube to water which enters the housing via an inlet 23 and is circulated within the housing 12 and past the wall 22. The combustion gases from the firetube are further caused to circulate through a series of further tubes 24, 26 and 28 as indicated by the several arrows in FIG. 1. By this means, the water circulating about the several tubes is eventually converted to steam which exits the boiler via an outlet valve 30. FIGS. 2A, 2B, 2C and 2D depict, in cross-section, those tubes within the boiler which are involved in each of the several passes of the hot combustion gasses along the longitudinal dimension of the boiler housing. In these Figures, the dashed line areas represent those tubes which are involved in the four depicted passes, the first of which is the firetube itself and the remaining three being the several additional heat transfer tubes indicated generally by the numerals 24, 26 and 28. As will appear more fully hereinafter, the present invention does not materially alter the configuration of the passes of the hot gases as depicted in FIGS. 1 and 2A–2D.

Figure 3:
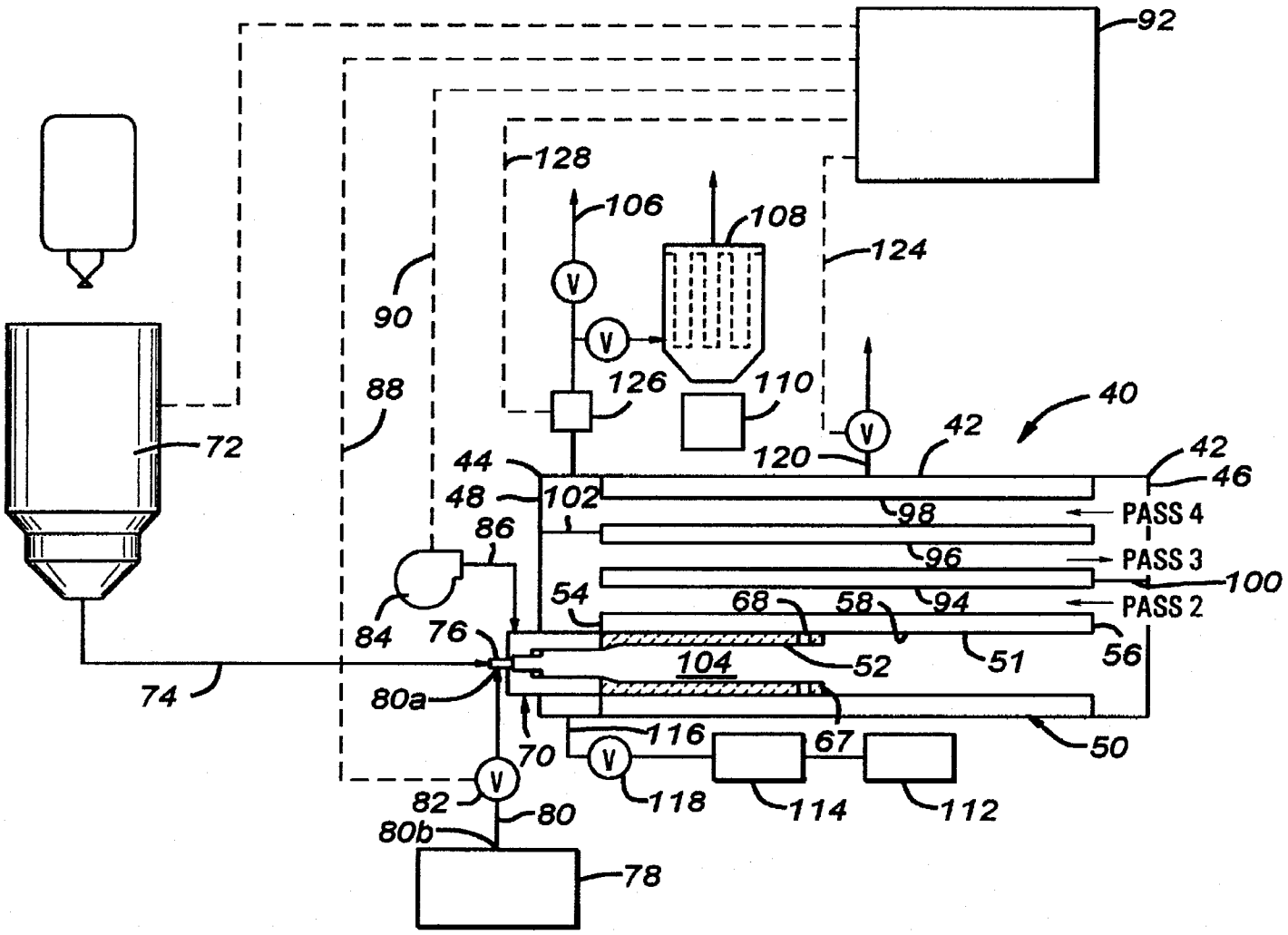
FIG. 3 is a schematic representation, part in section, of a firetube boiler which has been retrofitted in accordance with the present invention.
Figure 7:
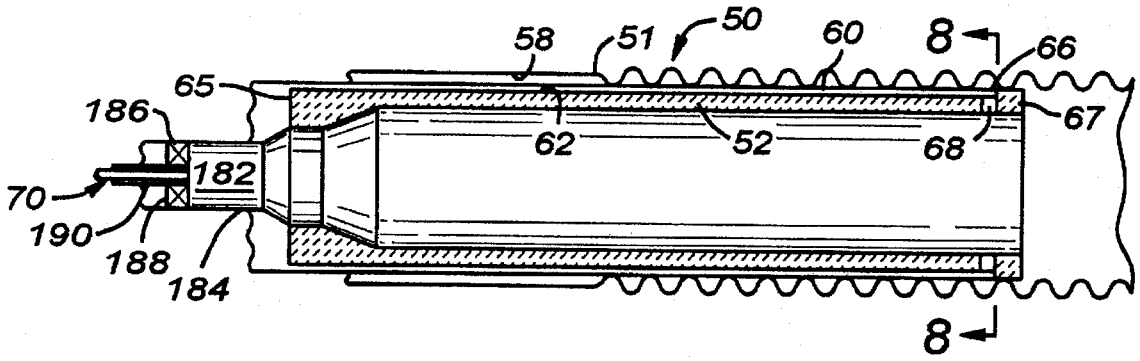
FIG. 7 is a schematic representation, part in section, of a firetube of a firetube boiler which has been retrofitted in accordance with the present invention and depicting the several locations for the introduction of fuel and combustion air to the firetube as per the present invention.

As depicted in the several Figures, with particular reference to FIGS. 3 & 7, a retrofitted boiler 40 embodying various of the features of the present invention, comprises an outer housing 42 which is generally tubular in geometry and which has its opposite ends 44 and 45 closed gas-tight as by means of end caps 46 and 48. Internally of the housing 42 there is mounted a firetube 50 made up of a cylindrical metal tube 51 within the interior of which there is provided a refractory liner 52 that extends from an inlet end 54 of the firetube 50 along the length dimension of the firetube to terminate at about the midpoint of the length of the firetube. The refractory liner 52 is concentric with and disposed contiguously to the inner wall 58 of the metal tube 56, except for an annular channel 60 (see FIG. 7) which is defined between the outer surface 62 of the refractory liner 50 and the inner surface 58 of the metal tube 51.

This annular channel 60 extends from the inlet end 65 of the refractory liner to a terminating location adjacent the downstream end 67 of the liner. Channel 60 serves as a passageway for the movement of secondary combustion air from the inlet end of the firetube to the terminating location of the channel. The terminal end 66 of the channel is provided with a plurality of inlet jets 68 each of which extends through the thickness of the refractory liner and provides a continuation of the channel 60 and further serves to permit the introduction of secondary combustion air from the channel into the interior of the firetube.

Figure 8:
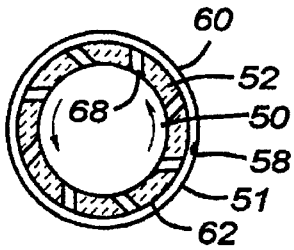
FIG. 8 is a cross-sectional view taken generally along the line 8—8 of FIG. 7 and depicting the angularity of the several air inlets for secondary combustion air to the firetube.

In a preferred embodiment as depicted in FIG. 8, each jet is oriented at an angle of about 20° with respect to the diametral dimension of the firetube so that the combustion air from the several Jets disposed about the circumference of the firetube (typically eight such jets) direct the incoming secondary combustion air into the firetube in a swirling motion, the direction of such swirl being counter to the swirl of the primary flame in the firetube.

Stated generally, the apparatus depicted in the several Figures, and particularly FIG. 3, further includes an inlet nozzle 70 provided on the inlet end 65 of the firetube. Coal from a storage hopper 72 is fed through a feed pipe 74 from the hopper to an eductor 76 provided as a part of the inlet nozzle 70. Motive air for the eductor 76 is provided by a pumping device or pressure source 78 which serves as a source of pressurized air. This pressurized air is fed via an air delivery line or conduit 80 to annular passageway 162 of the eductor 76.

Primary combustion air is introduced to the firetube as by a blower device or fan means 84 and a conduit 86. The fan means 84 is independently controlled to permit selection of the amount of combustion air introduced to the firetube by the fan means. Each of the means employed for supplying pressurized air to the eductor, and the operation of the fan means is controlled by appropriate control line connections 88 and 90, respectively, to a central controller 92 such as a microprocessor-based system controller.

Within the housing 40, in addition to the firetube 50, there is provided a plurality of heat tubes that extend just short of the length dimension of the internal length of the housing. These several tubes 94, 96 and 98 are divided into groups by separators 100 and 102 such that heated gases from the combustion chamber 104 of the firetube 50 are caused to make multiple passes along the length of the housing prior to their escape from the boiler through a flue gas stack 106. The passage of the combustion mixture along the length of the firetube is designated as "Pass 1" in the depicted boiler (see FIGS. 2A–2D and 3). The tubes depicted as solid black in FIGS. 2A–2D comprise the tubes along which the hot combustion gases flow following their exit from the firetube and are designated as "Pass 2".

Figure 2A:
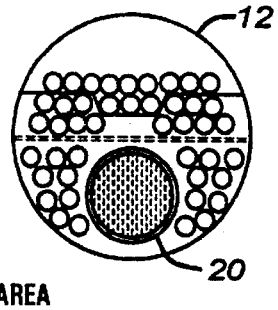
PRIOR ART FIG. 2A
FIGS. 2A, 2B, 2C and 2D are schematic cross-sectional views of a firetube boiler of the type depicted in FIG. 1 and showing the details of four passes of combustion gases through the several tubes of the boiler, the shaded areas of each of these Figures identifying the tube or tubes involved in each depicted pass.
Figure 2B:
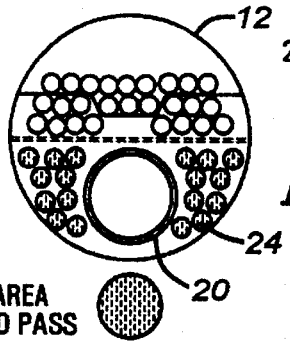
PRIOR ART FIG. 2B
Figure 2C:
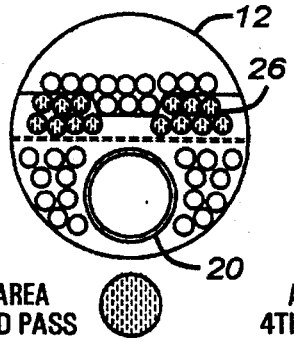
PRIOR ART FIG. 2C
Figure 2D:
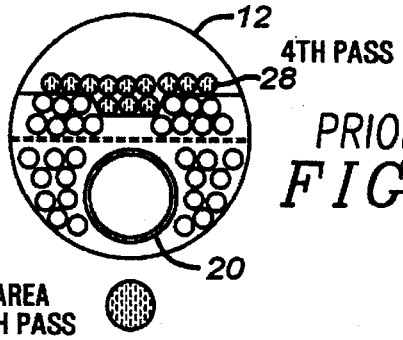
PRIOR ART FIG. 2D

Similarly, the tubes 96 and 98 which are involved in further flow of the hot gases along the length of the housing 42 are depicted in FIG. 2C and 2D, respectively, as "Pass 3" and "Pass 4". From "Pass 4", the combustion gases pass through the flue gas stack 106 and either to the ambient atmosphere or through a filter baghouse 108 and then to the ambient atmosphere.

Ash collected in the baghouse 108 drops to an ash receptacle 110 for subsequent disposal. Water from a source 112 is conveyed as by a pump 114, through a conduit 116 that includes a flow control valve 118, into the housing 42 where the water is caused to flow in heat exchanging relationship to the several heated tubes disposed within the housing such that the water is converted to steam within the boiler. This steam exits the boiler through a conduit 120 which is provided with a control valve 122 that is, in turn, connected by a control line 124 to the central controller 92.

As depicted, in a preferred embodiment, an oxygen sensor 126, such as a conventional automotive oxygen sensor, is interposed in the flue gas stack 106 such that the sensor is in position to detect the presence of oxygen in the flue gas exiting the boiler. By means of a control line 128, this oxygen sensor is connected to the central controller 92 to provide a means for the signal from the oxygen sensor to be fed to the controller and employed by the controller as an indicator of the excess air level in the boiler.

Based upon the signal from the oxygen sensor, the central controller 92 controls the operation of the fan means 84 to introduce more or less combustion air to the combustion chamber 104 of the firetube 50. The oxygen concentration in the flue gas is maintained at the desired level for maximum combustion efficiency by a control loop. This control loop is unique in that the oxygen measurement is effected by means of an inexpensive automobile oxygen sensor available off-the-shelf from an auto parts store. The sensor has a built-in resistance heater which is powered by a DC power supply to maintain the sensor at its correct operating temperature.

The output signal from the sensor is non-linear and has an amplitude in the millivolt range. The sensor is calibrated and the resulting polynominal coefficients are used to calculate a direct readout of the flue gas oxygen content. A special filter fabricated from Gore-Tex filter media is employed to prevent fouling of the sensor by flue gas contaminants. Oxygen concentration in the flue gas is used as the process feedback to a PID control loop that controls the combustion air blower speed.

A variable speed AC motor drive changes the frequency and amplitude of the three-phase, 208 volt, power to the blower motor based on the 4/20 milliamp signal from the oxygen controller. The blower speed regulates the amount of air flowing into the firetube and thus the oxygen content in the flue gas. This technique of controlling combustion air flow provides the advantages of high fuel economy in the boiler, as well as electrical power savings, since the blower motor is running at the minimum speed necessary to provide the required air flow. Dampers are not used.

Figure 5:
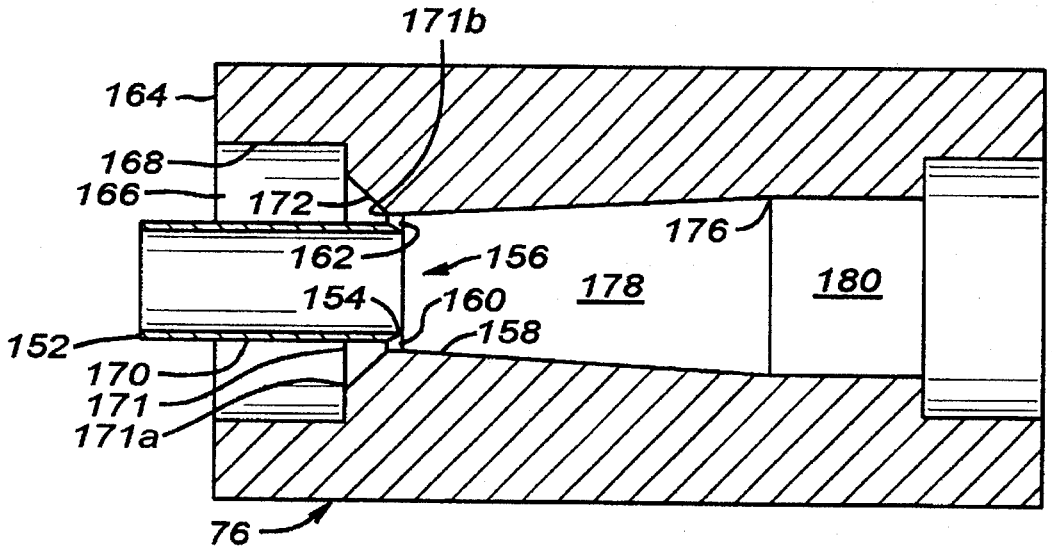
FIG. 5 is a schematic cross-sectional representation of the coal injection system of the present invention.

The present invention also comprises a coal injection system, as shown in FIG. 5. The coal injection system of the present invention comprises an eductor 176 comprising an inlet region 166, a reducer region 171 comprising a large diameter and 171*a* adjacent the inlet region and a small diameter end 171*b* opposite the large diameter end. The eductor further comprises a mixing chamber 178 extending longitudinally through the eductor. The mixing chamber comprises a smaller diameter end 156 adjacent the small diameter end of the reducer region and a larger diameter end 176 opposite the smaller diameter end. As shown in FIG. 5, the mixing chamber increases in internal diameter from its smaller diameter end to its larger diameter end. The inlet region, reducer region, and mixing chamber form a longitudinal bore through the eductor.

The coal injection system of the present invention further comprises a coal delivery tube 152 having a first end attachable to a source of finely divided coal of uniform density and pressure and a second end extending through the inlet and reducer regions of the eductor and terminating in the mixing region of the eductor near the smaller diameter end of the mixing region. The coal delivery tube has an outer diameter slightly less than the smaller diameter of the mixing region. The coal delivery tube is concentrically located within the eductor so as to form an annular passageway 162 external to the coal delivery tube. The annular passageway has sufficient width to permit air injected into the annular passageway to draw a vacuum at the second end of the coal delivery tube.

In a preferred embodiment, the second end of the coal delivery tube is chamfered. Also, in a preferred embodiment, the reducer region of the eductor is formed by a beveled surface 172, as shown in FIG. 5. In a preferred embodiment, a spacing device 160, such as a spider means, is inserted in the annular passageway for maintaining the coal delivery tube in concentric relationship with the eductor. The spacing device is capable of allowing air to flow past it.

In a preferred embodiment, the chamfer on the coal delivery tube is chosen to be about 30 degrees, and the bevel 172 is chosen to be about 45 degrees. Both angles are relative to the longitudinal centerline of the eductor.

In the depicted embodiment, the pressurized motive air is accelerated by reason of the moving air being forced into the eductor past a beveled annulus 172 defined in the eductor upstream of the annulus 162. Thus, the incoming pressurized motive air is caused to be accelerated such that its flow rate past the terminus 154 of the coal delivery tube creates a vacuum at the terminus. This vacuum functions to draw finely divided coal from the coal delivery tube and convey it into the throat 156 of the eductor. Further, the change in direction of the incoming motive air from a generally laminar flow in the inlet region 166 to a highly turbulent flow immediately downstream of the terminus of the coal delivery tube results in good mixing of the coal and air to create an excellent combustion mixture.

As seen in FIG. 5, the mixing chamber 178 increases in internal diameter or circumference from a location adjacent the terminus of the coal delivery tube to a location 176 larger diameter end of mixing chamber spaced downstream of the delivery tube. By reason of this increasing diameter or circumference, there is an increasing volume of the initial mixing chamber 178 in a direction downstream from the terminus of the coal delivery tube. As the mixture of motive air and coal enters this initial mixing chamber and moves along the length thereof, the air expands and preferably achieves supersonic velocity, thereby creating further mixing of the coal and air. The coal-air mixture passes through a series of shocks in the diverging section of the eductor where the static pressure rises to match the exit condition in the combustor.

The flowing mixture of coal and air is accelerated to supersonic velocity while the static pressure of the mixture is increased to the static pressure of the combustion chamber of the system.

Within the combustion chamber, the initial mixture of coal and air has added thereto primary combustion air sufficient only to develop a reducing environment within the primary combustion chamber. For example, the quantity of motive air and primary combustion air, combined, is selected to develop a stoichiometry of about 0.55 within the primary combustion chamber. By this means, the formation of nitrogen oxides within the combustion chamber is minimized, while there is optimization of the combustion of the carbon in the coal.

Adjacent the downstream end of the primary combustion chamber, secondary combustion air is introduced to the combustion chamber, preferably in the form of a series of circumferentially disposed and angled jets such that the secondary air entering the combustion chamber generates a counter swirl which both stabilizes the combustion flame, and enhances mixing of the secondary air with the combustion flame while reducing the extent to which the secondary combustion air advances in a direction reverse of the direction of the combustion flame. This secondary combustion air importantly functions to increase the stoichiometry of the combustion chamber to about 1.20 thereby developing an oxidative environment which functions to complete combustion of CO and $H_2$ in the reducing gas exiting the primary zone.

The present invention also comprises a coal-feed system for use with a coal-injection system of a firetube boiler. The coal-feed system comprises a coal hopper 72, comprising an upper opening 132 capable of receiving finely divided coal, a substantially conical bottom region 138, and a lower opening 140 located at the base of the bottom region.

The coal-feed system further comprises a gyratable bin 141, comprising a bin inlet 141*a* aligned with said lower opening, a substantially conical base region 141*c*, and a discharge outlet 141*b* located at the end of said base region. The discharge outlet has a smaller diameter than the lower opening.

The coal-feed system also comprises a gyration device 149, mechanically coupled to said gyratable bin and capable of sufficiently gyrating the bin to reduce the probability that finely divided coal that may be received in the bin will clump.

Figure 4B:
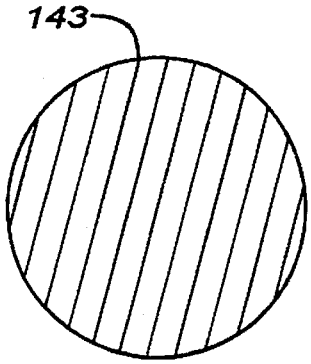
FIG. 4B is an enlarged top view of the internal structure of the discharge plenum depicted in FIG. 4A, at the plane where the support pad is mounted.
Figure 4C:
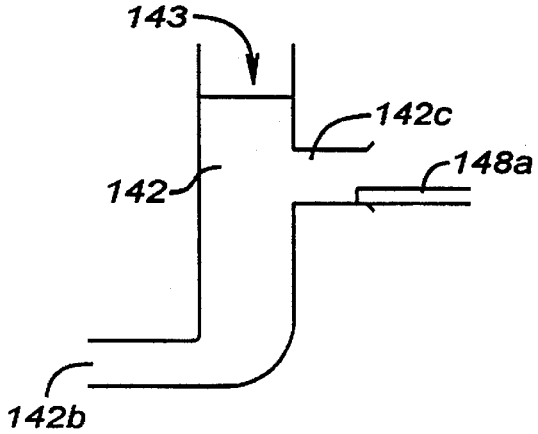
FIG. 4C is a side view of an embodiment of a portion of the coal feed injection system of the present invention.

The coal-feed system further comprises a discharge plenum 142 aligned with the discharge outlet. The discharge plenum comprises a fluidizing support pad 143 capable of supporting finely divided coal received in the discharge plenum, a fluid-injection inlet 142*b*, capable of receiving fluid of sufficient pressure and flow rate to fluidize finely divided coal received in the discharge plenum, a lower region 142*a* and a coal outlet 142*c* located in the lower region. In a preferred embodiment, the fluidizing support pad is made from a water resistant material such as GORTEX™. The support pad is depicted in FIG. 4B. In another preferred embodiment, the coal outlet is located between the support pad and the fluid-injection inlet as shown in FIG. 4C.

The coal-feed system further comprises a feed-conveyor device 148, having a first end 148*a* installed in the coal outlet. The conveyor device is configured to convey finely divided, fluidized coal away from the discharge plenum. In a preferred embodiment, the conveyor device is motor-driven. In another preferred embodiment, the conveyor device is an auger.

Figure 4A:
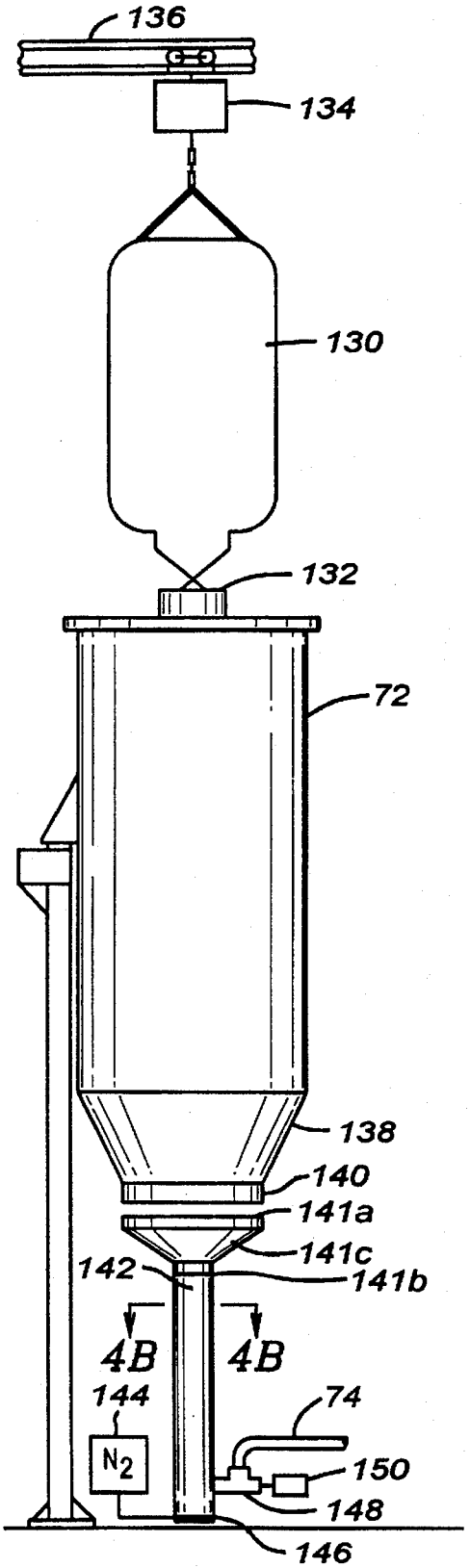
FIG. 4A is a schematic representation of a coal storage and feed system for supplying finely divided coal to the eductor unit of the present system.

In another preferred embodiment, the coal-feed system further comprises a source of pressurized inert gas 144 in fluid communication with the fluid injection inlet. In a preferred embodiment, this gas is nitrogen, as shown in FIG. 4A.

In a preferred embodiment, the coal-injection system of the present invention further comprises an air delivery line 80 comprising a first end 80*a* connected to the annular passageway, and a second end 80*b* opposite the first end, as shown in FIG. 3. This embodiment further comprises a flow control device 82 installed in the delivery line and a pressure source 78 connected to the second end of the delivery line. The pressure source is capable of injecting motive air into the annular passageway. In a preferred embodiment, the flow control device 82 is a flow control valve, as shown in FIG. 3. In another preferred embodiment, the degree to which the flow control valve is opened or closed is controllable in response to a process-variable control signal. The process variable which generates the control signal may be mode of pressure. The process-variable control signal may be generated from the centrol controller 92, as shown in FIG. 3.

As best seen in FIGS. 3 and 7, the outfeed of mixed coal and air from the eductor 76 is introduced into a first section 182 of a primary combustion chamber 184. Concurrently with the introduction of the coal-air mixture to this first section 182, primary combustion air from a source 84 thereof is introduced to the first section through a set of angled vanes 186. These angular vanes 186 disposed in an annular opening 188 formed between the outer wall 190 of the tail end of the eductor and the inner wall 192 of the first section 182 of the primary combustion chamber. By this means, the primary air is mixed well with the coal-air mixture from the eductor and there is imparted a stabilizing swirl to the combustion flame which begins to form in the first section 182 of the primary combustion chamber.

First and second annular beveled surfaces 194 and 196, respectively, within the inner circumference of the primary combustion chamber at spaced apart locations along the length of the chamber are provided to increase the diameter of the first section to the diameter of the refractory-lined section. The first of these bevels forms an angle of about 45 degrees with the longitudinal centerline of the annular primary combustion chamber, while the second beveled surface forms an angle of about 15 degrees with the longitudinal centerline. Each bevel is oriented such that there is an increase in the circumference of the inner circumference of the first section 182 in the direction of the flow of the coal-air mixture along the first section, thereby resulting in a two-step expansion of the volume of the first section and a corresponding decrease in the velocity of the coal-air mixture.

Downstream of the first section 182 of the primary combustion chamber 184 there is provided an tubular refractory lining 52 for the firetube 50. This lining defines a second section 198 of the primary combustion chamber and it is within this second section that there occurs a majority of the combustion of the coal. In a preferred embodiment, the refractory lining extends from the inlet nozzle 70 along the length of the firetube to approximately the midpoint of the length of the firetube.

In another aspect of the present invention, the previously described coal-injection system may be coupled with the previously described coal-feed system. In this embodiment, the invention comprises an eductor, as previously described, a feed pipe 74 extending between said coal outlet and the first end of the coal-delivery tube such that finely divided, fluidized coal can be conveyed from the discharge bin to the delivery tube.

In a specific embodiment of the present apparatus, a 200 BHP (boiler horsepower) Cleaver-Brooks firetube boiler, which originally was designed to be fueled with gas or oil was retrofitted in accordance with the concepts of the present invention. This boiler, as originally designed is depicted in FIGS. 1 and 2A–2D.

The initial steps in retrofitting the boiler in question included removal of the original burner and the substitution therefor of an eductor designed in accordance with the present invention, and the provision of a refractory lining to the interior of the firetube to isolate the combustion flame from the metal wall of the firetube.

Figure 6A:
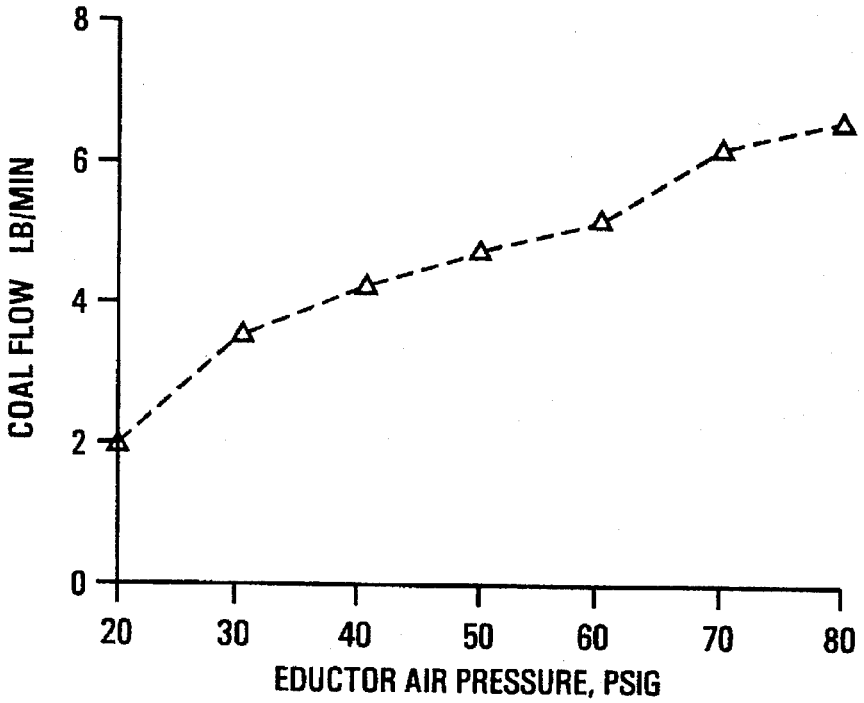
FIGS. 6A and 6B are graphs depicting the coal flow rate and vacuum, respectively, at the feed line exit from the coal storage system depicted in FIG. 4 versus the eductor motive air pressure.
Figure 6B:
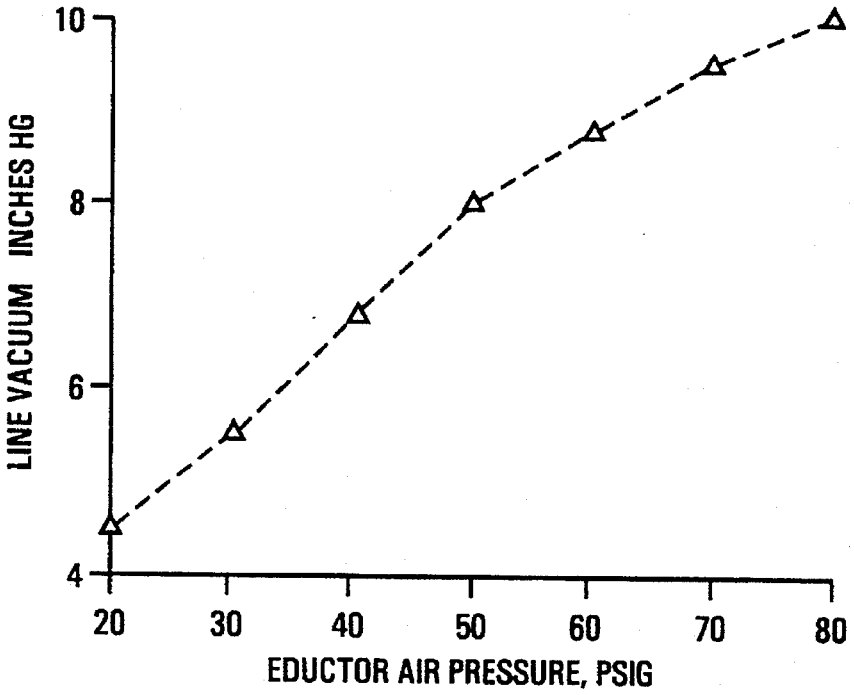

The eductor employed in this retrofitting was of the type depicted in FIG. 5. Specifically, the coal delivery tube 152 was of 0.50 inch O.D.×0.43 inch I.D. The annular spacing between the terminus of the coal delivery tube and the throat of the eductor was 0.030 inch. High pressure motive air at a pressure of between about 20 and 80 psig was introduced via the passageway 166 and upon passing through the annular spacing 162 was elevated to sonic velocity and developed a vacuum of between about 4.5 and 10.0 inches Hg at the terminus of the coal delivery tube. FIG. 6B presents a graph which shows the relationship of the vacuum to the motive air pressure. Static pressure in the suction area of the eductor ranged from about 9 psia to 12 psia, depending on the driving air pressure and coal flow rate. For a given driving air pressure and coal flow rate, the suction pressure is constant, so for a coal feed line with repeatable pressure drop characteristics, the coal flow rate can be controlled by varying the driving air pressure. In the present system, reliable control of coal flow rate was achieved over a range from 2.0 to 6.5 lb/min by varying the motive air pressure as further shown in FIG. 6A. Under other conditions of operation, firing rates that exceeded 6,000,000 Btu per hour were achieved.

Concurrent burner performance (turndown ratio) exceeded the range of 3.25 to 1, thereby exceeding the goal of 3 to 1 for turndown. The following Table I shows a 3.29 turndown ratio measured with 3 scfh of fluidizing nitrogen in the plenum of the coal storage unit and Upper Elkhorn No. 3 coal:

TABLE I

| Motive Air Pressure, psig | Motive Air Flow Rate, lb/min | Coal Flow Rate, lb/min | Coal Firing Rate, Btu/h |
|---|---|---|---|
| 80 | 6.58 | 6.52 | 5,868,000 |
| 20 | 2.43 | 1.98 | 1,782,000 |

In the present invention, the arrangement of the coal feed system is deemed of importance for proper operation of the eductor coal feed system. The feed system is designed to supply coal at the inlet end of the coal delivery tube at a uniform density and pressure. As depicted in FIG. 4 and described hereinabove, the coal feed system includes a hopper, a gyrating bin discharger and a fluidized discharge plenum. The gyrating bin discharger keeps coal flowing smoothly from the large hopper into the plenum. A pressure cone in the bin discharger supports the weight of the coal above the entrance of the discharge plenum, thus maintaining a relatively constant pressure head in the discharge plenum. The discharge plenum may consist of a 12 inch diameter tube with a fluidizing gas, such as nitrogen, being admitted to the plenum at the bottom thereof. The contents of the hopper are not fluidized. This arrangement assures that coal cannot pack at the entrance of the coal delivery tube, which would result in erratic coal flow and would eventually lead to line plugging. The fluidizing gas in the present example amounted to about 0.2% by weight of the coal flow. An auger located at the inlet to the coal delivery tube served to break up any lumps of coal before they entered the feed line. This auger, however, does not meter the flow of coal through the coal delivery tube. In the control of the flow of coal into the firetube, the control variable is eductor motive air pressure, which is maintained at a constant set point by a feedback control loop.

In a boiler retrofitted in accordance with the present concepts, initiation of coal combustion may be by means of a propane pilot (not shown in the Figures). Preferably, the refractory liner is preheated prior to initiation of the coal combustion, such preheating serving to reduce the formation of soot in the tubular refractory lining. No propane is used when the coal is being combusted and no preheating of the combustion air is required.

To alleviate adverse effects upon the boiler operation by reason of soot or ash buildup within the firetube 50, the end cap 46, and in the tubes, 94, 96 and 98, sootblowers were installed on the Cleaver-Brooks firetube boiler for cleaning the individual boiler tubes in the second, third and fourth passes. These sootblowers were installed at the pass 1-2, 2-3 and 3-4 turn-around areas. A sootblowing lance which was insertable at the exit end of the main firetube (pass 1) as also installed to remove deposits from the firetube walls. Scrapers were installed at the pass 1-2 turnaround area to remove deposits from the refractory lining in the endcap and the tube sheet at the entrance of the second pass tubes.

The sootblowers for the individual boiler tubes consist of ¼ inch o.d.×0.035 inch wall stainless steel tubes which are directed toward the upstream end of each boiler tube in the second, third, and fourth passes. The second pass had 46 tubes; the third and fourth passes each had 30 tubes. The sootblower tubes are connected to three separate headers on the second pass, in groups of 16, 15 and 15. The sootblowing medium is 120 psi nitrogen, but compressed air could be used for commercial retrofits. The tubes in the second pass were type 310 stainless steel, which demonstrated good corrosion resistance in the firetube exit area. The tubes on the other passes were type 316 stainless steel. In order to install the sootblowers on the second and fourth passes, it was necessary to drill an individual hole for each tube through the boiler end bell and the refractory inside, as there was no room for headers inside the boiler. The third pass installation was much simpler, because there was room for an internal header. The sootblowers were operated during the combustion tests and were effective in removing dust from the boiler tubes.

The first-pass firetube sootblower lance consisted of a ½ inch schedule 40 carbon steel pipe. The end of the pipe was welded shut and two opposed 7/16 inch diameter holes near the end of the pipe directed compressed nitrogen toward the firetube walls. The lance was operated in a manner similar to a typical retractable sootblower. It was slowly rotated as it was inserted into the firetube and nitrogen flow was maintained for the entire time it was inserted to prevent overheating. The lance was inserted to a depth slightly downstream of the station of the secondary air jets, and then retracted. The sootblower lance was operated during the tests and was effective in removing deposits from the firetube walls and maintaining heat transfer and exit gas temperatures.

The deposit scrapers at the pass 1-2 turnaround area were constructed from ½ inch o.d.×0.125 inch wall stainless steel tubing. The scrapers were located so they could be rotated across the surface of the refractory lining in the endcap or across the tube sheet. The scrapers were permanently installed inside the boiler; a small continuous flow of cooling air was passed through the tubing to keep the metal temperature at an acceptable level. The scrapers were operated during the tests, and were effective in removing deposits from the refractory and tube sheet.

Tests of the retrofitted 200 BHP Cleaver-Brooks firetube boiler were conducted. Three coals were used. These coals, and their properties are identified in Table II.

TABLE II

| Fuel Sample | UE3, Medium Ash | UE3, High Ash | Illinois No. 6 available MDH coal |
|---|---|---|---|
| | Coal Analyses | | |
| Identification | Standard DOE test fuel used for contract; Dry, ultra-fine coal; Medium ash content; High ash-fusion temperature | Dr, ultra-fine coal High ash content; High ash-fusion temperature | UTSI finely, pulverized; Very high ash content; Very low ash-fusion temperature |
| Ash % as fired | 2.4 | 6.5 | 11.4 |
| Moisture % as fired | 0.9 | 0.9 | 3.1 |
| Sulfur % as fired | 0.6 | 0.7 | 3.1 |
| Nitrogen % as fired | 1.5 | 1.5 | 1.3 |
| Volatile Matter % as-fired (VM) | 36.9 | 35.1 | 36.8 |
| High Heating Value Btu/lb as-fired | 14.780 | 13.800 | 11,740 |
| Minimum Ash Fusion Temperature, °F. | 2,500 | 2,500 | ≦2,100 |
| Lb-Coal/MBtu | 67.7 | 72.5 | 85.2 |
| Lb-Ash/MBtu | 1.6 | 4.7 | 9.7 |
| Lb-S/MBtu | 0.4 | 0.5 | 2.6 |
| Lb-N/MBtu | 1.0 | 1.1 | 1.1 |
| Lb-VM/MBtu | 25.0 | 25.4 | 31.4 |
| Elemental ash analysis: | | | |
| $SiO_2$ | 45.5 | 51.7 | 42.5 |
| $Al_2O_3$ | 30.8 | 33.4 | 16.1 |
| $Fe_2O_3$ | 11.3 | 5.6 | 17.2 |
| $TiO_2$ | 1.6 | 1.6 | 0.7 |
| CaO | 1.8 | 2.0 | 3.6 |
| MgO | 1.11 | 0.9 | 0.7 |
| $Na_2O$ | 1.9 | 0.6 | 0.3 |
| $K_2O$ | 2.4 | 2.3 | 9.4 |
| $SO_3$ | 2.5 | 2.1 | 8.6 |
| $Cr_2O_3$ | 0.1 | 0.1 | 0.1 |
| $P_2O_5$ | 0.5 | 0.2 | 0.4 |
| Median Particle Diameter, μm | 9 | 9 | 39 |
| DRY BASIS: | | | |
| Proximate | | | |
| Ash | 2.4 | 6.6 | 11.8 |
| Volatile Matter | 37.2 | 35.4 | 38.0 |
| Fixed Carbon | 60.4 | 58.0 | 50.2 |
| Ultimate | | | |
| Ash | 2.4 | 6.6 | 11.8 |
| Carbon | 83.2 | 79.4 | 66.0 |
| Hydrogen | 5.5 | 5.3 | 4.5 |
| Nitrogen | 1.5 | 1.5 | 1.3 |
| Sulfur | 0.6 | 0.7 | 3.2 |
| Oxygen by Difference | 6.8 | 6.5 | 13.2 |
| Btu/lb. HHV | 14,910 | 13,930 | 12,120 |

During testing of the retrofitted 200 bhp Cleaver-Brooks boiler, $NO_x$ emissions of 0.44 lb/MBtu were achieved using standard micronized Upper Elkhorn No. 3 coal with about 2.4% ash, at a firing rate of 3.6 MBtu/h. Carbon burnout was 99.1%. The maximum design firing rate for the 200 bhp Cleaver-Brooks boiler is 8.3 MBtu/h for natural gas of fuel oil firing; however, using the two-stage burner described hereinabove with coal firing produced a flame that was longer than the 15-foot firetube when the firing rate was much greater than 6 MBtu/h. Therefore, 6 MBtu/h was the maximum firing rate of this boiler during normal operation on coal.

Figure 11:
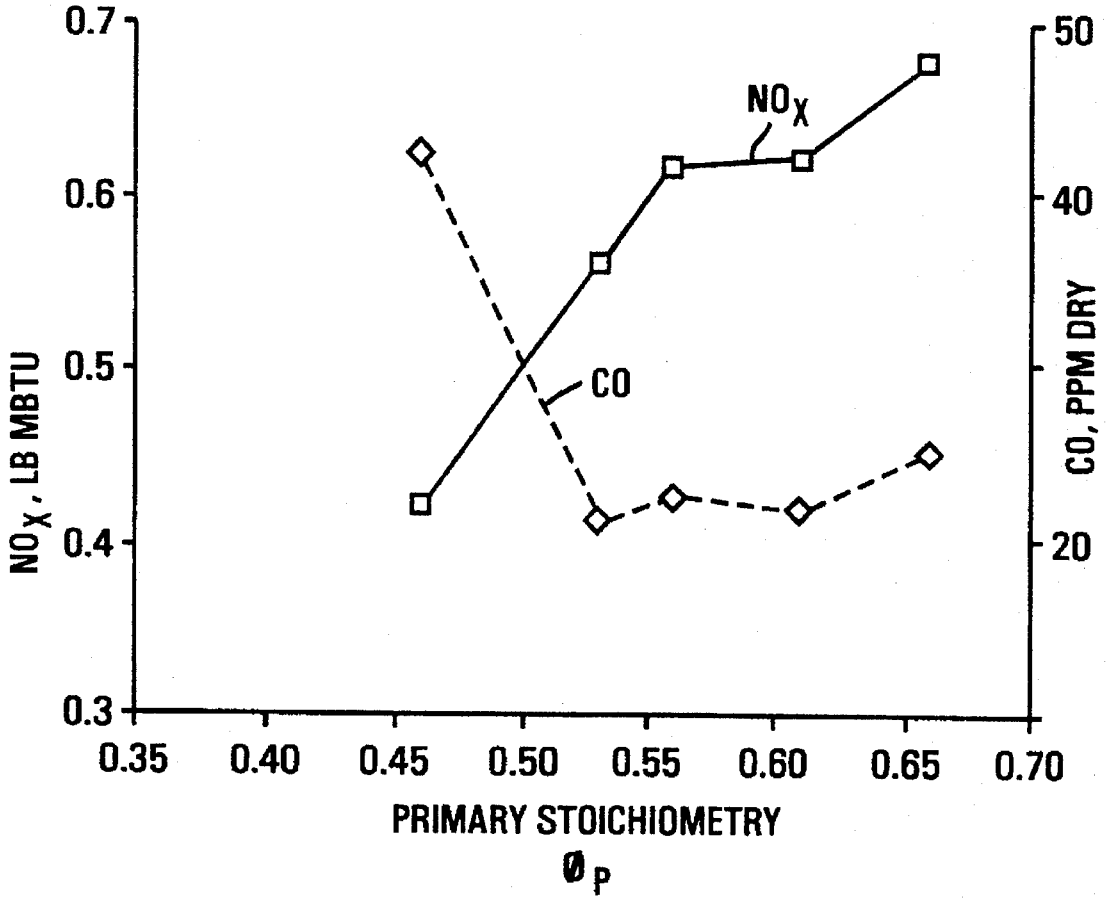
FIG. 11 is a graph depicting $NO_x$ and CO emissions versus primary stoichiometry.

$NO_x$ and CO emissions were found to be very sensitive to primary zone stoichiometry, $\Phi_p$. As shown in FIG. 11 $NO_x$ emission increases with increasing $\Phi_p$ in the range from 0.45 to 0.65. CO emission remains relatively constant at 20 to 30 ppm as $\Phi_p$ decreases from 0.65 to about 0.55, then increased rapidly as $\Phi_p$ drops below 0.55. It was found that CO emission must be maintained at about 40 ppm or lower in order to achieve carbon burnout efficiency near 99%. Thus, a primary combustion zone stoichiometry of 0.55 was found to provide the best combination of combustion efficiency and low $NO_x$ emission. This value for $\Phi_p$ also corresponds roughly to the lowest stoichiometry at which enough oxygen is available in the primary combustion zone to convert all carbon to CO. In a preferred combustor configuration, about 12% of the combustion air enters through the eductor, about 33% enters through the primary air swirler, and the remaining 55% enters through the secondary air jets. Burner operation was stable with a final stoichiometry, $\Phi_t$ down to about 1.10; however $\Phi_t$ was maintained at about 1.20 during normal operation to maximize carbon burnout.

Figure 9:
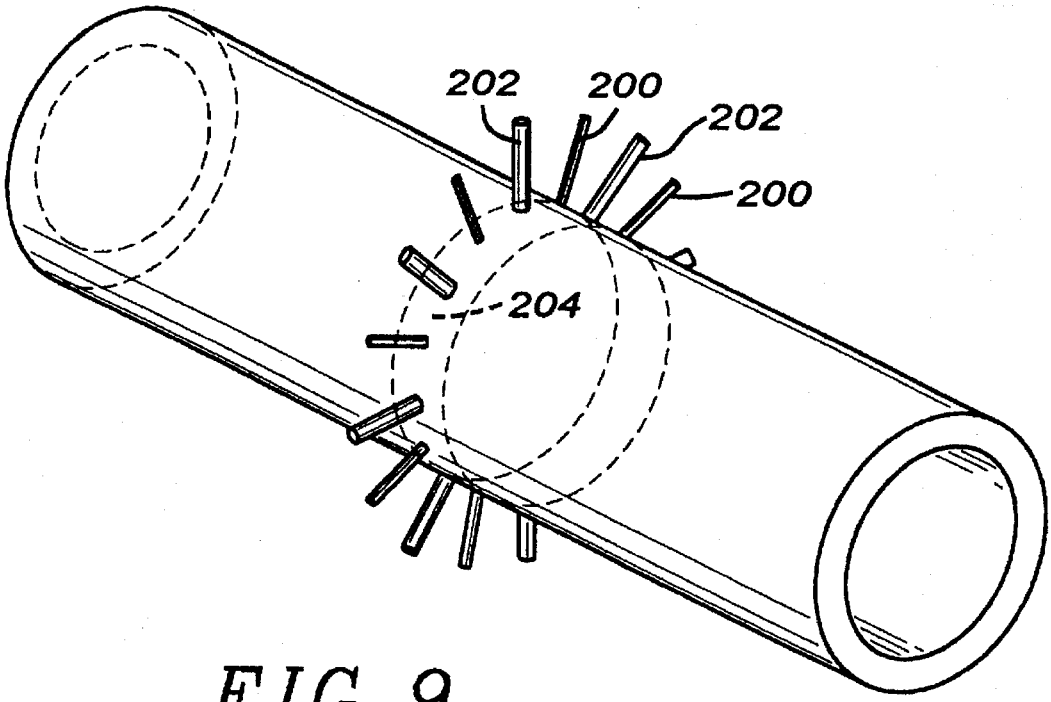
FIG. 9 is a schematic representation of a firetube which is provided with auxiliary circumferential jets for injecting a gaseous fuel or supplementary combustion agent to the interior of the firetube at a location disposed approximately halfway along the length of the firetube.
Figure 10:
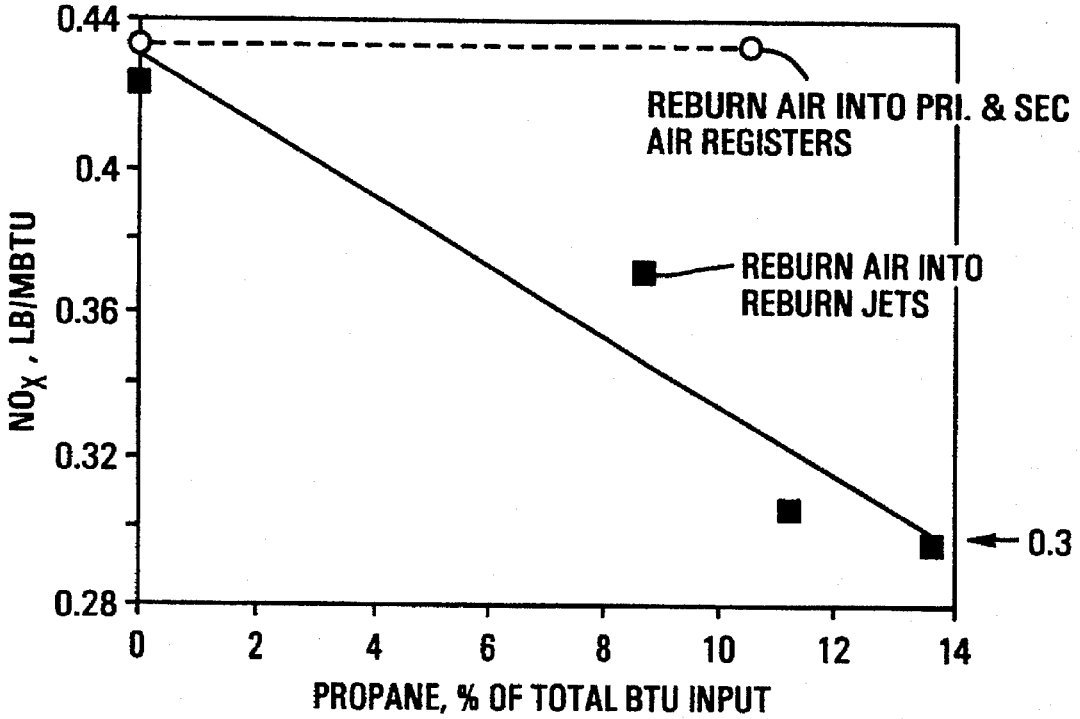
FIG. 10 is a graph comparing the $NO_x$ emissions from a retrofitted firetube boiler with and without reburning capabilities.

In accordance with one aspect of the present invention, reduction of the emission of $NO_x$ is accomplished to a lower level, than that achieved in the two-stage burner. This was accomplished by establishing a third combustion zone 204 (see FIG. 9) in the approximate midpoint of the length of the refractory lining by introducing into the firetube propane or natural gas through a series of jets 200 disposed about the circumference of the firetube. Optionally, alternating ones 202 of these jets was used in inject combustion air into the firetube, along with the propane or natural gas. FIG. 8 presents the results of tests of a boiler equipped to provide the third combustion zone (i.e., reburning).

In this latter three-stage burner configuration, it was found that addition of the additional "reburn" combustion air at either the primary or secondary combustion air inlets did not result in reduced $NO_x$ emission, even though the propane or natural gas was admitted to establish the third stage of combustion. On the other hand, when the reburn air was added at the same plane as the propane or natural gas, the stoichiometry can be maintained near the optimum value throughout the primary combustion chamber, and a significant reduction in $NO_x$ resulted. For example, a reduction in $NO_x$ emission from about 0.42 lb/MBtu to about 0.30 lb/MBtu was achieved with 13.7% of the heat input, as a percentage of the total coal+propane heat input, from propane.

Still further tests were conducted of the retrofitted 200 HP Cleaver-Brooks boiler using dry, ultra fine (8 micrometer median particle diameter) high ash-fusion Upper Elkhorn #3 coals with 2.4 and 6.6% ash (DUC's), and a sample of low ash-fusion coal with 11.4% ash which was finely pulverized to 39 micrometer median particle diameter. The results of these tests are given in Table III.

TABLE III

| | Goal | Accomplishment |
|---|---|---|
| Combustion Efficiency | >99.0 | 99.3 |
| Boiler Efficiency | >80.0 | 86.5 |
| Burner Turndown Ratio | >3.1 | >3.5:1[1] |
| Emissions (lbs/$10^6$ Btu) | | |
| $SO_2$ | <1.2 | 0.81 |
| $NO_x$ | <0.7 | 0.53; <0.3[2] |
| Particulates | <0.6 | <0.05 |
| Support Fuel | None | None |
| Air Preheat | None | None |

[1]Without using any support fuel or preheating the combustion air.
[2]With propane reburning supplying 14% of the Btu input.

Figure 12:
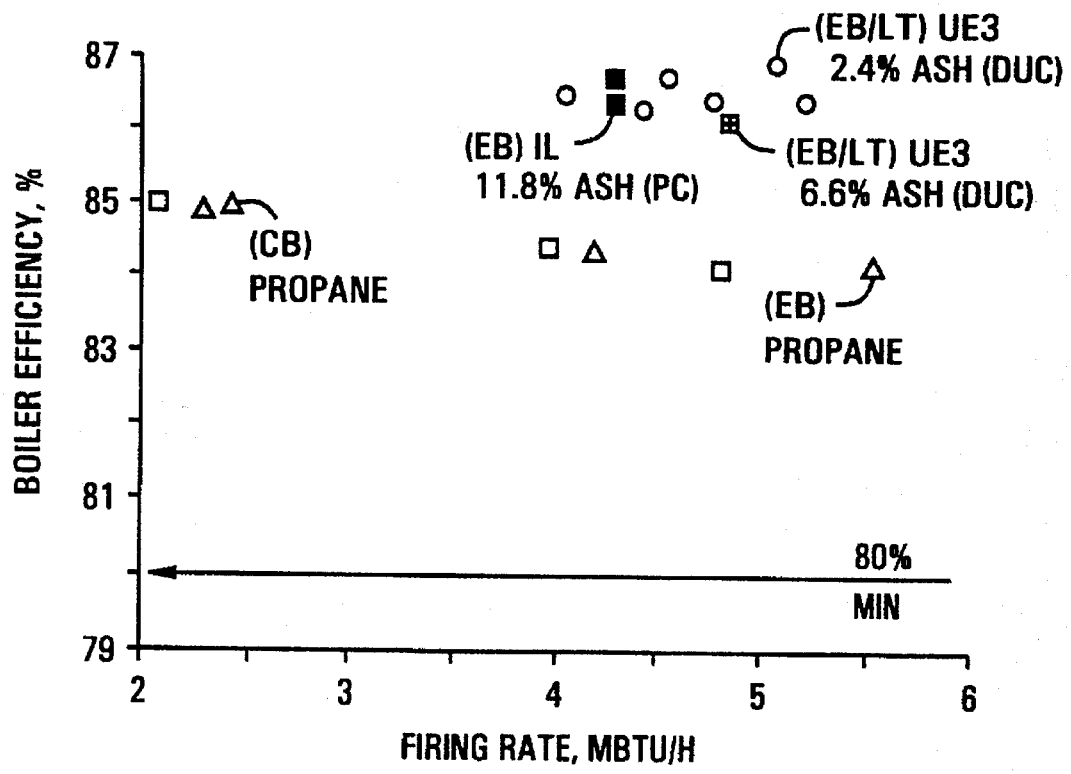
FIG. 12 is a graph depicting boiler efficiencies versus firing rates for various fuels.

From Table III, it will be noted that these further tests resulted in greater than 80% boiler efficiency, greater than 99% combustion efficiency, less than 1.2 lbs of $SO_2$ emissions per million Btu burner input, less than 0.7 lb $NO_x$ emissions per million Btu burner input, and less than 0.6 lb of particulate emissions per million Btu burner input, thereby meeting, and in all cases exceeding, the goals set for the system. Boiler efficiencies measured during these tests are given in graph format in FIG. 12. These boiler efficiencies were calculated using the American Boiler Manufacturers Association (ABMA) method. Boiler efficiencies were between 86 and 87% during all the tests. Boiler efficiencies for propane firing are also plotted in FIG. 12 for the retrofitted burner (EB), and the original Cleaver-Brooks burner (CB). Boiler efficiencies for propane firing were very similar for the retrofitted burner and the original Cleaver-Brooks burner.

Figure 13:
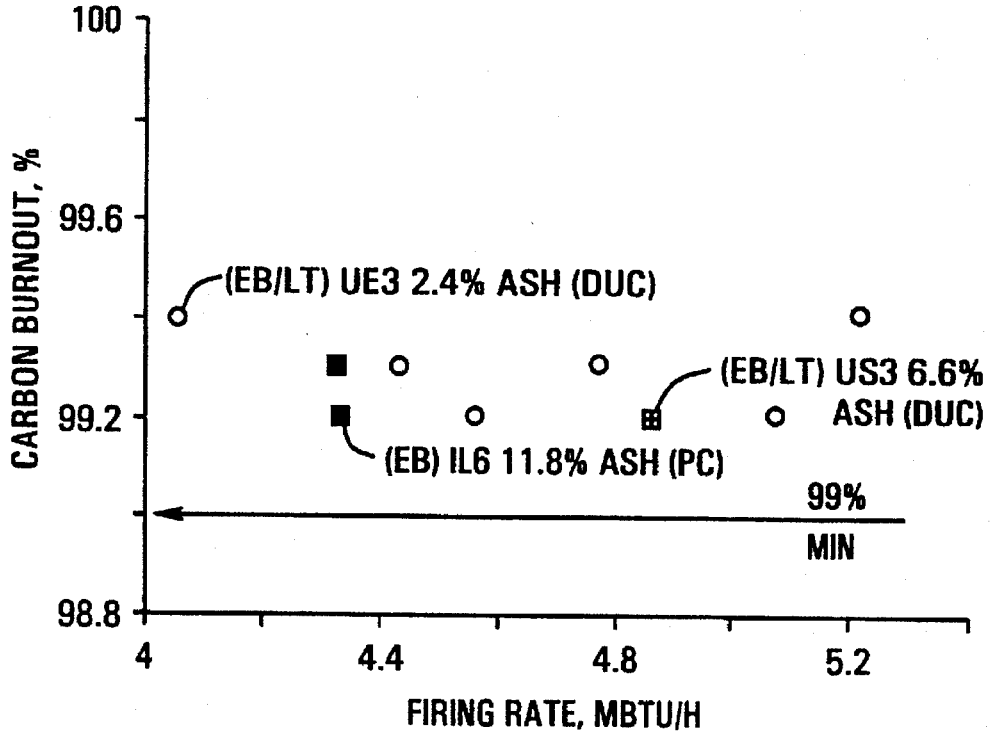
FIG. 13 is a graph depicting carbon burnout values versus firing rate for various coals.

Carbon conversion efficiencies measured during these tests are plotted as a function of average firing rate in FIG. 13. Carbon conversion efficiencies were between 99.2 and 99.4% during the tests. Carbon burnout for the finely-pulverized Illinois No. 6 coal was similar to the ultra-fine UE3 coals, even though the mean particle diameter of the Illinois No. 6 was much larger (39 micrometer versus 9 micrometer) thereby indicating that expensive micronizing is not required in order to achieve a high carbon conversion efficiency in a retrofitted boiler.

Figure 14:
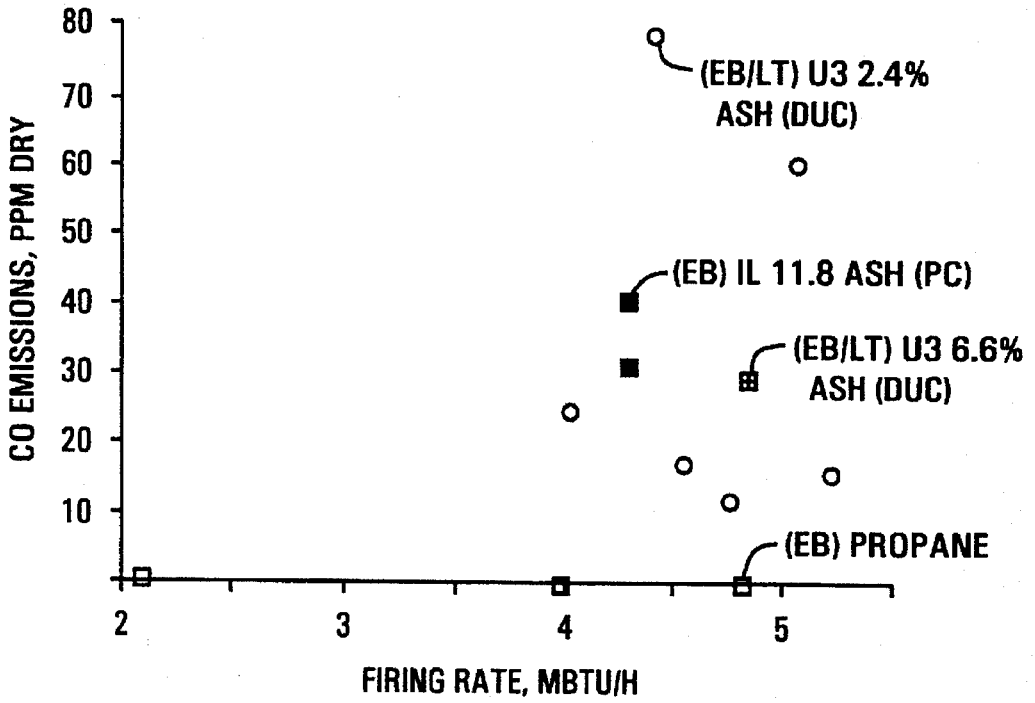
FIG. 14 is a graph depicting typical CO emissions versus firing rate for various fuels.

Carbon monoxide (CO) emissions during these tests are plotted as a function of average firing rate in FIG. 14. CO emissions were typically less than 60 PPM. The higher CO emissions measured during two of the tests were caused by ash deposits at the firetube exit, which interfered with burner operation.

Sulfur dioxide ($SO_2$) emissions were limited to about 0.8 lb/MBtu during most of the tests due to the low sulfur content of the UE3 coals. Emissions while firing Illinois No. 6 were higher, indicating the desirability of using low-sulfur coals.

Figure 15:
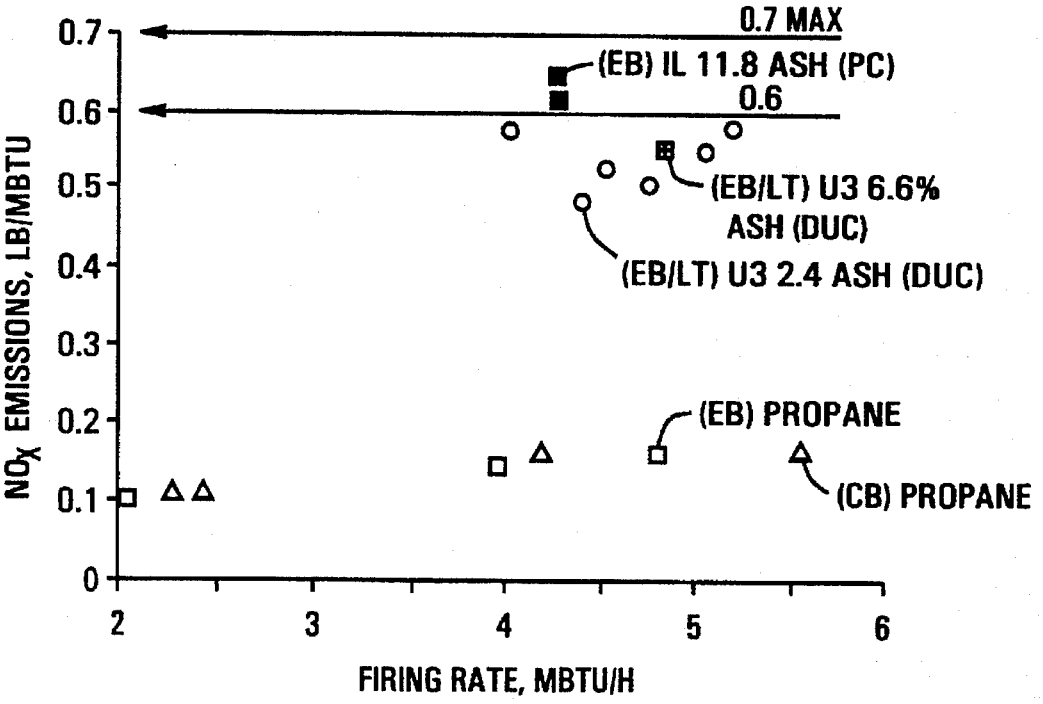
FIG. 15 is a graph depicting $NO_x$ emissions versus firing rate for various fuels.

$NO_x$ emissions measured during the tests are plotted as a function of firing rate in FIG. 15. $NO_x$ emissions were less than 0.6 lb/MBtu during all of the tests when UE3 coals were fired. Emissions were slightly above 0.6 lb/MBtu when Illinois NO. 6 was fired. As noted hereinabove, $NO_x$ emission is strongly dependent on primary stoichiometry. Carbon conversion efficiency suffers if the primary stoichiometry drops much below 0.55. Reburning using propane or natural gas to establish a third combustion zone may be used to both reduce the $NO_x$ emissions and obtain high carbon conversion efficiency. $NO_x$ emission levels below about 0.4 lb/MBtu can be achieved with reburning.

Dust emission rates indicated that the flyash produced by combustion of micronized UE3 coal is not particularly difficult to collect. Extrapolation of the test data indicates that a steady state pressure drop of about 2.5 inches of water could be maintained at a filtration velocity of 3 ft/min, or about 4 inches of water at 4 ft/min. Standard woven fiberglass bag material performs adequately in the retrofitted boiler application.

In terms of the cost of steam generated, the retrofitted boiler of the present invention, using finely pulverized coal substituted for propane represents an annual savings in excess of 850,000 for the same steam production employing a 200 bhp firetube boiler.

What is claimed:

1. A coal injection system for use with a coal burning firetube boiler, comprising:

a. an eductor comprising an inlet region, a reducer region comprising a large diameter end adjacent said inlet region and a small diameter end opposite said large diameter end, and a mixing chamber extending longitudinally through said eductor, said mixing chamber comprising a smaller diameter end adjacent the small diameter end of said reducer region and a larger diameter end opposite said smaller diameter end, said mixing chamber increasing in internal diameter from its smaller diameter end to its larger diameter end, said inlet region, reducer region, and mixing chamber forming a longitudinal bore through said eductor; and b. a coal delivery tube having a first end attachable to a source of finely divided coal of uniform density and pressure and a second end extending through said inlet and reducer regions and terminating in said mixing region near the smaller diameter end of said mixing region, said tube having an outer diameter slightly less than the smaller diameter of said mixing region and said tube further being concentrically located within said eductor so as to form an annular passageway around the perimeter of said tube in said eductor, said passageway having sufficient width to permit air injected into said annular passageway to draw a vacuum at the second end of said tube.

2. The apparatus of claim 1, further comprising a spacing device inserted in said annular passageway for maintaining said tube in concentric relationship with said eductor, said spacing device capable of allowing air to flow past it.

3. The apparatus of claim 2, wherein said spacing device is a spider means.

4. The apparatus of claim 1, wherein the second end of said coal delivery tube is chamfered.

5. The apparatus of claim 4, wherein the degree of chamfering is approximately 30 degrees.

6. The apparatus of claim 1, wherein said reducer region is beveled at approximately 45 degrees.

7. The apparatus of claim 1, further comprising:

a. an air delivery line comprising a first end connected to said annular passageway and a second end opposite said first end;

b. a flow control device installed in said delivery line; and c. a pressure source connected to the second end of said delivery line, said pressure source capable of injecting motive air into said annular passageway.

8. The apparatus of claim 7, wherein said flow control device is a flow control valve.

9. The apparatus of claim 8, wherein the degree to which said flow control valve is opened or closed is controllable in response to a process variable control signal.

10. The apparatus of claim 9, wherein said process variable is motive pressure.

11. A coal feed system for use with a coal injection system of a firetube boiler, comprising:

a. a coal hopper, comprising an upper opening capable of receiving finely divided coal, a substantially conical bottom region and a lower opening located at the base of said bottom region;

b. a gyratable bin comprising a bin inlet aligned with said lower opening, a substantially conical base region and a discharge outlet located at the end of said base region, said discharge outlet having a smaller diameter than said lower opening;

c. a gyration device mechanically coupled to said gyration bin and capable of sufficiently gyrating said bin to reduce the probability that finely divided coal that may be received in said bin will clump;

d. a discharge plenum aligned with said discharge outlet comprising a fluidizing support pad capable of supporting finely divided coal received in said discharge plenum, a fluid injection inlet capable of receiving fluid of sufficient pressure and flow rate to fluidize finely divided coal received in said discharge plenum, a lower region, and a coal outlet located in said lower region between the support pad and the fluid injection inlet; and e. a feed conveyor device having a first end installed in said coal outlet, said conveyor device being configured to convey finely divided, fluidized coal away from said discharge plenum.

* * * * *